US009903622B2

(12) United States Patent
Provenziani

(10) Patent No.: US 9,903,622 B2
(45) Date of Patent: Feb. 27, 2018

(54) COMPACT HEAT EXCHANGER

(71) Applicant: PROVIDES METALMECCANICA S.R.L., Latina (IT)

(72) Inventor: Franco Provenziani, Latina (IT)

(73) Assignee: PROVIDES METALMECCANICA S.R.L., Latina (IT)

( * ) Notice: Subject to any disclaimer, the term of this patent is extended or adjusted under 35 U.S.C. 154(b) by 35 days.

(21) Appl. No.: 15/126,205

(22) PCT Filed: Mar. 25, 2014

(86) PCT No.: PCT/IB2014/060129
§ 371 (c)(1),
(2) Date: Sep. 14, 2016

(87) PCT Pub. No.: WO2015/145200
PCT Pub. Date: Oct. 1, 2015

(65) Prior Publication Data

US 2017/0082330 A1 Mar. 23, 2017

(51) Int. Cl.
*F28B 3/00* (2006.01)
*F25B 39/00* (2006.01)
(Continued)

(52) U.S. Cl.
CPC ..... *F25B 39/00* (2013.01); *F28D 3/02* (2013.01); *F28D 3/04* (2013.01); *F28D 5/02* (2013.01);
(Continued)

(58) Field of Classification Search
CPC .. F25B 39/00; F25B 39/028; F25B 2339/021; F28D 3/02; F28D 3/04; F28D 5/02;
(Continued)

(56) References Cited

U.S. PATENT DOCUMENTS 4,300,481 A * 11/1981 Fisk ..... F22B 37/266 122/406.3
4,439,146 A * 3/1984 Sugita ..... F27B 9/3077 118/500
(Continued)

FOREIGN PATENT DOCUMENTS

| | | | |
|---|---|---|---|
| DE | 19953612 | A1 | 5/2001 |
| EP | 2604944 | A1 | 6/2013 |
| WO | 2012077143 | A1 | 6/2012 |

OTHER PUBLICATIONS

International Search Report and Written Opinion for International Application No. PCT/IB2014/060129 (8 Pages) (dated Jan. 19, 2015).

*Primary Examiner* — Davis Hwu
(74) *Attorney, Agent, or Firm* — Lucas & Mercanti, LLP

(57) ABSTRACT

A heat exchanger of flooded type, having:
- a primary tube bundle, inside which a first "hot" operating fluid to be cooled down flows;
- a skirt, circumscribed to the primary tube bundle, which receives a second "cold" operation fluid which laps against the primary tube bundle in order to subtract heat to the first operating fluid,
- which second operating fluid flows inside the skirt along to a vertical longitudinal direction orthogonal to the development of the tubes of the primary tube bundle, and wherein the skirt has a prevalent development dimension (L) along the flow longitudinal direction of the second operating fluid; and
- nozzles for delivering the secondary operating fluid inside the skirt, wherein an alternative configuration is provided using only the second operating fluid flooding the skirt by entering from a side inlet, without the presence of the above-mentioned
(Continued)

nozzles, and an additional configuration using only the nozzles but not such side inlet.

9 Claims, 6 Drawing Sheets

(51) Int. Cl.

| | |
|---|---|
| ***F28D 3/02*** | (2006.01) |
| ***F28D 3/04*** | (2006.01) |
| ***F28D 5/02*** | (2006.01) |
| ***F28D 7/16*** | (2006.01) |
| *F25B 39/02* | (2006.01) |

(52) U.S. Cl.
CPC ..... *F28D 7/1623* (2013.01); *F25B 39/028* (2013.01); *F25B 2339/021* (2013.01); *F25B 2339/0242* (2013.01); *F25B 2500/23* (2013.01)

(58) Field of Classification Search
CPC .. F28D 7/1623; F28F 9/08; B01D 3/14; F24F 12/001
USPC ..... 165/111
See application file for complete search history.

(56) References Cited

U.S. PATENT DOCUMENTS

| | | | | |
|---|---|---|---|---|
| 4,669,530 | A | 6/1987 | Warner | |
| 4,930,571 | A * | 6/1990 | Paull | F24F 12/001 165/111 |
| 5,507,356 | A * | 4/1996 | Roth | B01D 3/14 165/111 |
| 2002/0011329 | A1 * | 1/2002 | Peterson | F28B 9/08 165/111 |
| 2005/0006064 | A1 | 1/2005 | Garimella | |
| 2009/0178790 | A1 | 7/2009 | Schreiber | |
| 2013/0285266 | A1 | 10/2013 | Telvick | |

* cited by examiner

A
100
11
12
A
103
104
107
108
106
101
102
105
BOLTS
3
6
7
10
2
9
8
80
BOLTS
A,L
5

COMPACT HEAT EXCHANGER

CROSS-REFERENCE TO RELATED APPLICATIONS

This application is a 371 of PCT/IB2014/060129, filed Mar. 25, 2014.

TECHNICAL FIELD OF THE INVENTION

The present invention relates to a heat exchanger and, in particular, to an evaporator. Such evaporator can be of the so-called "flooded" type or of the so-called "falling-film" (both hybrid, that is even flooded, and pure) type.

The exchanger of the invention is specifically suitable to be used in conditioning industrial plants.

BACKGROUND

A first type of heat exchanger, a very widespread type for industrial use, is that of the so-called "flooded" evaporators.

As well known for a person skilled in the art, this type of exchanger provides a skirt acting as outer casing, inside which one or more tube bundles are housed, wherein a first operating fluid flows, in particular a so-called "hot" fluid. Inside the skirt, then, over the free surface, a so-called "cold" second operating fluid, that is a refrigerating fluid, is fed. The latter laps against the tube bundle(s) with the purpose of the heat exchange with the first fluid, it subtracts heat to the latter and evaporates by flowing towards a vapour-sucking orifice placed on the top.

The second fluid, at the end of the stage of thermal exchange with the first fluid and therefore at the top of the skirt of the exchanger, should result wholly vaporized. However, a drawback which often is met is that in the second operating fluid liquid particles remain which can damage the components downwards the exchanger or however determining an operation under not nominal conditions thereof.

In order to avoid or limit said drawback, the extension of the free surface of the refrigerant inside the skirt is made very wide. This is obtained by conferring the skirt a strongly widened, and in particular horizontally elongated shape. The extension of the skirt is strongly prevalent in a horizontal direction orthogonal to the flow direction of the second fluid inside the skirt itself and parallel to the extension direction of the tubes inside thereof the first "hot" operating fluid flows. In particular, the section area of the skirt on the horizontal plane is highly prevalent with respect to the one of the vertical section enveloping the tube bundle involved by the first operating fluid, the relationship between the two areas being higher than 2.5.

Still to obviate said drawback, the free surface is kept quite "low" with respect to the top of the skirt wherein the vapour-sucking orifice is placed. In this way, the "ascending" speed of the vapour from the free surface towards the sucking orifice is very low and consequently the dragging of liquid drops during the ascent is limited.

However, said widened shape of the exchanger generally makes it very bulky. Furthermore, the huge cross extension of the free surface involves a huge consumption of refrigerant fluid which, as it is known, has very high costs as well as an important environment impact.

Furthermore, still in order to avoid the above-mentioned drawback, an auxiliary unit for overheating the second operating fluid, or a system for filtering the dragged drops of liquid or even a system which makes it difficult the passage of refrigerant drops downwards the primary tube bundle with respect to the flow of the second operating fluid. Even these expedients involve an increase in the overall dimensions and, of course, in the costs.

Another very widespread type of heat exchanger for industrial use is that of the so-called "falling-film" evaporators.

As well known for a person skilled in the art, even the type of "falling-film" evaporator provides a skirt acting as outer casing, inside thereof one or more tube bundles are housed wherein a first operating fluid flows, in particular a so-called "hot" fluid. In the falling-film configuration of "pure" type, a second so-called "cold" operating fluid—that is a refrigerating fluid—is fed inside the skirt only through a distribution system with nozzles preferably placed above the tube bundles mentioned above. The liquid phase of such second fluid deposits onto the outer surface of the tubes of the row immediately below the distribution system, in this way by exchanging heat with the primary fluid and by evaporating partially. The remaining liquid portion "falls" by gravity onto the rows of the lower tubes, by distributing effectively even thereon, by forming a liquid "film" and thus by triggering an evaporation process with high efficiency of thermal exchange.

In the type of evaporators with falling film of hybrid type, a tube portion of the tube bundle arranged in the lower portion of the skirt is wholly dipped in the liquid refrigerant, by operating in reality like the type of the "flooded" evaporators, whereas the upper portion of the tube bundle operates like the just described pure type of the "falling-film" evaporators.

Even in this second type of evaporators, the second fluid, at the end of the stage of thermal exchange with the first fluid and therefore at the top of the skirt of the exchanger, should result wholly vaporized. However, even in this case in the second operating fluid liquid particles remain which can damage the components downwards of the exchanger or however determine an operation under not nominal conditions thereof. In the herein considered type of evaporator this drawback is particularly difficult to be avoided as the refrigerant outgoing from the distribution system is in counterflow with respect to the mass of the ascending vapour produced by the evaporation of the refrigerant on the tubes and directed towards the sucking orifice of the exchanger. The mass flows of these opposed flows are approximately equal and typically equal to the nominal rate of the refrigerating machine thereto the evaporator belongs.

To obviate such drawback, a first solution consists in using a separator of liquid/vapour placed on the refrigerant circuit, downwards the throttling valve, upwards an inlet/recirculation of the refrigerant in the distribution system which feds the evaporator. The separated vapour is conveyed on the sucking line of a compressor or however it does not come in contact with the tube bundle of the evaporator, whereas the accumulated liquid is brought to feed the evaporator by means of the distribution system. In this way a smaller mass flow of the refrigerant flowing into the evaporator is obtained, and therefore fewer dragging problems and a consequent better distribution of liquid even on the lower rows of the tube bundle, as the distribution thereof by gravity is less disturbed by the flow of the ascending vapour.

A second adopted solution is that of using a so-called "in-line" configuration of the tube bundle, wherein the tubes are arranged in horizontal rows and vertically aligned. In such way, the exceeding liquid falling by gravity finds thereunder an aligned whole column of tubes and, at the same time, the ascending vapour finds extension passage "preferential lanes" equal to the distance between two columns of adjacent tubes. In such way, the liquid-dragging effect and the disturbing effect of the distribution of the latter on the tubes are reduced. However, at the upper rows of the tubes (that is near the distributor, wherein the opposed mass flows are high) the problem of the liquid dragging is not solved in a satisfying way.

Another adopted solution is to use a hood wrapping on the top and on the side the tube bundle and prevents the produced vapour to flow in counter-flow with respect to the liquid refrigerant in the fall by gravity on the rows of tubes. In particular, in such solution the distributor is generally placed inside the hood—on the top of the tube bundle—and the configuration is so that the distributed liquid and the produced vapour both follow in the same direction, from the top to the bottom, as far as the vapour outgoes from the hood through suitable side openings and it can proceed through suitable channels ascending towards the sucking orifice. In such configuration, generally a lower portion of the tube bundle is left to operate wholly dipped in the liquid refrigerant, so as to receive and to make to evaporate the liquid not evaporated on the upper tubes. However, even this solution involves an increase in the involved volumes.

In brief, the known evaporators considered sofar request huge volumes on the refrigerant side, have huge overall plan dimensions due to the development of the skirt on the horizontal plane and generally they require additional components to solve the problem of dragging the liquid to the sucking orifice of the evaporated refrigerant.

SUMMARY OF THE INVENTION

The technical problem placed and solved by the present invention is then to provide a heat exchanger allowing to obviate the drawbacks mentioned with reference to the known art.

Such problem is solved by a heat exchanger according to claim 1.

Preferred features of the present invention are subject of the depending claims.

The heat exchanger of the invention has reduced overall dimensions, in particular on the refrigerant side. Furthermore, it decreases substantially the problem of dragging the liquid to the sucking orifice of the evaporated refrigerant, without requiring additional components.

In particular, in the embodiment wherein the exchanger operates like a flooded evaporator, the free surface facing towards the vapour sucking orifice is very small and, consequently, the flow speed of the gas/vapour inside the skirt towards the sucking (outlet) orifice is very high. In this way, thanks to such high ascending speed, the second operating fluid drags in a pushed way the liquid refrigerant upwards, making that the latter wets the tubes of the primary tube bundle lying along the path and then acting as "feeder" for the remaining tube bundle. In this sense, the exchanger of the invention acts in opposite way with respect to the known exchangers, wherein, as said above, specific expedients are adopted to prevent or limit such dragging.

In this way, the consumption in the liquid refrigerant is reduced drastically, the refrigerating power being equal, and then the associated costs and potential environmental impact. Even the insertion of an auxiliary overheating unit downwards the primary tube bundle or other additional components, suitable to solve the problem of sucking drops of liquid refrigerant, becomes less critical.

In a preferred embodiment, the spray or jet delivery means of the second operating fluid is provided inside the skirt, according to a "falling-film" configuration. This allows an additional decrease in the quantity of required refrigerant, the power being equal.

Such delivery means can be provided to operate divided into two or more groups, each one distributing refrigerant at an intermediate level of the tube bundle.

Such groups can be all fed by the same refrigerant feeding line, or further grouped in by-groups, each by-group being fed separately by a specific refrigerant feeding line. The mass flow of such line(s) can be adjusted based upon specific parameters, such as for example the level of the free surface of the refrigerant liquid in the skirt, the overheating value of the vapour outgoing from the evaporator, the value of the pressures or other.

According to the embodiment variant, the delivery means can be provided in combination with a specific feeding of refrigerant creating a base free surface—that is in the context of a flooded exchanger of "classical" type—or in absence of the latter. In case of a pure "falling-film" solution, that is in a not flooded exchanger, the above-mentioned effects of pushed dragging of liquid refrigerant upwards are usually obtained.

The exchanger of the invention then, the power being equal, results to have reduced overall dimensions both of a flooded evaporator of classical type and a "falling-film" evaporator, the latter of hybrid or pure type.

Another important advantage of the invention is that of obtaining very high efficiencies of thermal exchange by using an extremely reduced quantity of refrigerant fluid.

Other advantages, features and use modes of the present invention will result evident from the following detailed description of some embodiments, shown by way of example and not with limitative purpose.

BRIEF DESCRIPTION OF THE DRAWINGS

The figures of the enclosed drawings will be referred to, wherein.

DETAILED DESCRIPTION OF PREFERRED EMBODIMENTS

Figure 1:
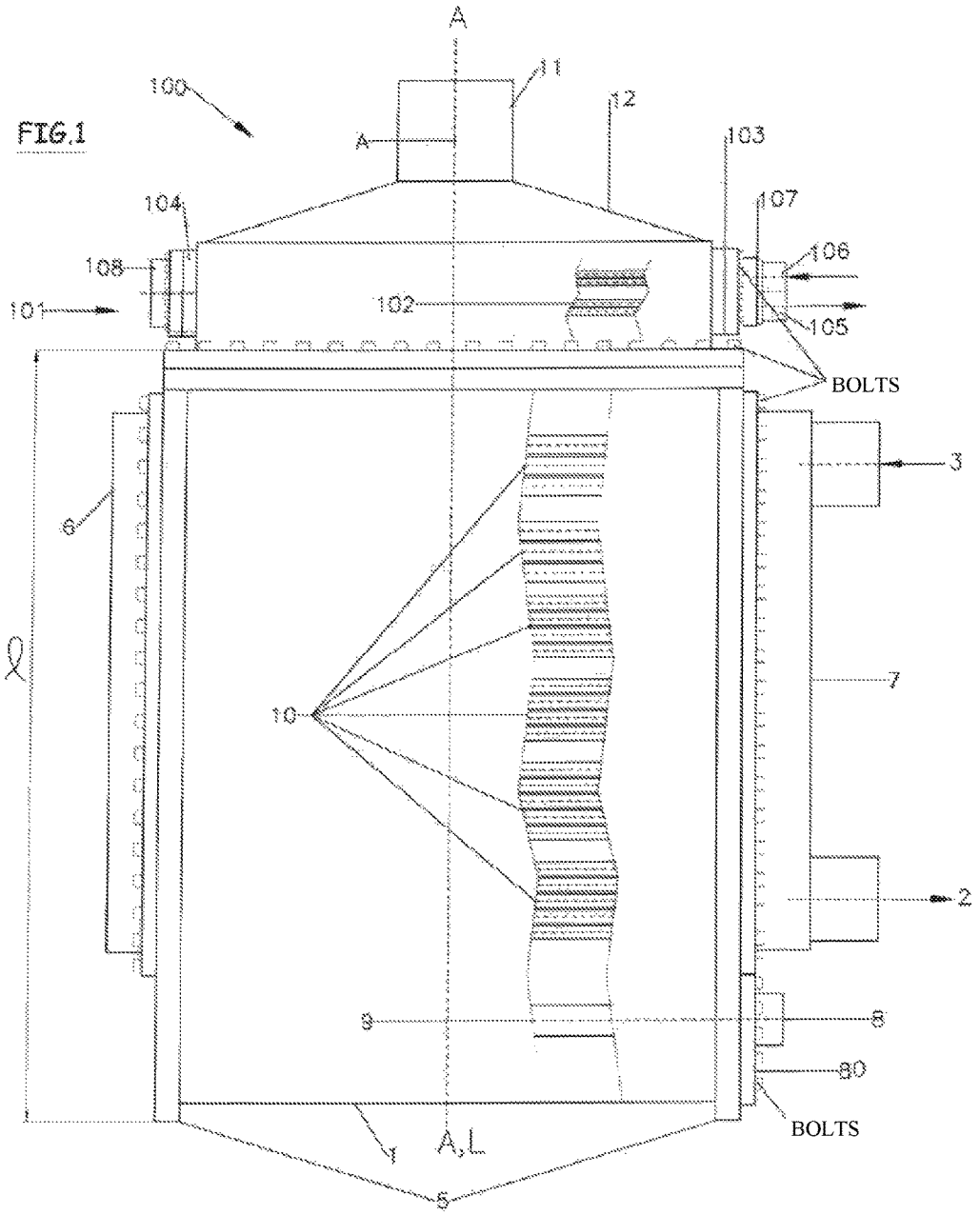
FIG. 1 shows a front, partially cut-away view of a first preferred embodiment of the heat exchanger according to the present invention.
Figure 3:
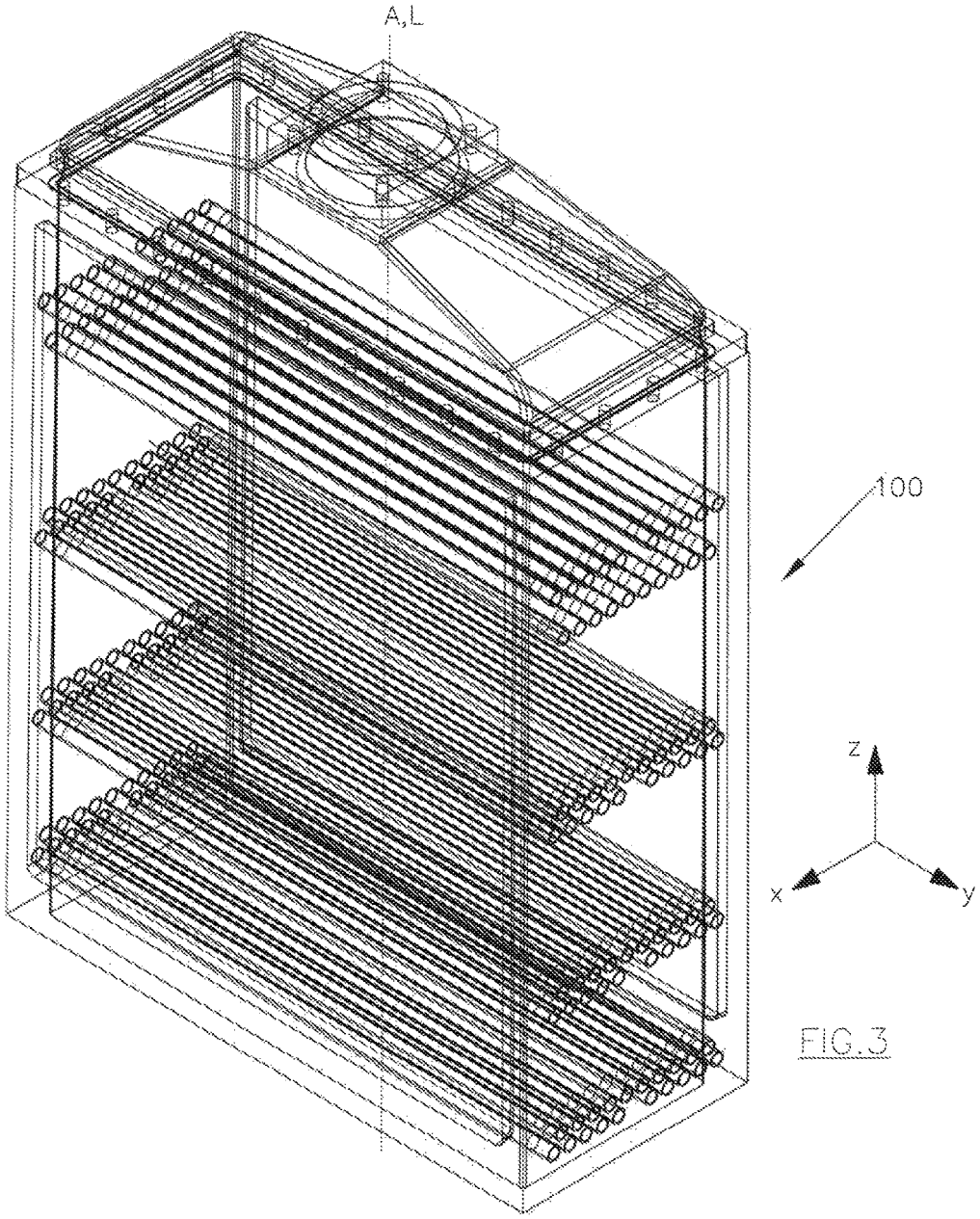
FIG. 3 shows a perspective view of the exchanger of FIG. 1.

By firstly referring to FIGS. 1 and 3, a heat exchanger according to a preferred embodiment of the invention is designated as a whole with 100. In the present example, the heat exchanger 100 is an evaporator, in particular of the so-called flooded type.

The exchanger 100 comprises a skirt 1 acting as outer casing. The skirt 1 has a prevalent development dimension designated with/in FIG. 1, which will be called longitudinal. In particular, such prevalent development dimension corresponds to a direction L which, in use, results to be vertical or substantially vertical. In the present example, this is also the direction of a longitudinal axis A of the skirt 1 itself. Still in the present example, the skirt 1 has a parallelepiped-like or substantially parallelepiped-like geometry.

Inside the skirt 1 at least a primary tube bundle 10 is housed, wherein a first operating fluid flows, in particular a so-called "hot" fluid to be cooled-down. Such first operating fluid is fed inside the primary tube bundle 10 by means of an inlet 3 and it outgoes therefrom through an outlet 2 (or viceversa) arranged in the same portion of the skirt 1 with respect to the inlet 3. The inlet and the outlet 3 and 2 can be under the form of connectors or nozzles of known type on itself. In the present embodiment, the first operating fluid is water. Application variants can provide the use of water with antifreeze agent or other fluids/additives, including refrigerant fluids both under the conditions of monophasic and biphasic state.

The tubes of the primary bundle 10 cross transversally the space inside the skirt 1 according to a serpentine-like path, with at least a go-tract and at least a return-tract. In particular, in the present example a plurality of go-tracts and a plurality of return-tracts are provided.

The tubes are supported by two tube plates 5 arranged bilaterally on the skirt 1, in particular at opposite side walls of the skirt itself. Such tube plates 5 can be permanently constrained to the skirt 1 for example by means of welding or by means of screws fastening to the skirt itself, or as implemented in the same melting of the skirt.

The tubes of the primary tube bundle 10 can have cross sizes, and in particular diameters, different therebetween.

At the opposite wall of the skirt 1 with respect to the one associated to the inlet 3 and to the outlet 2, even a collector or closing bottom 6 is provided, arrange outside the respective tube plate 5 and constrained thereto. The collector 6 collects water—or other primary fluid—coming from the upper portion of the serpentine-like path of the primary tube bundle 10 and it feeds the lower portion of the same.

A similar closing bottom or head 7 is provided at the wall of the skirt 1 receiving the inlet 3 and the outlet 2, even in this case arranged outside the respective tube plate 5 and constrained thereto.

Inside the skirt 1 then, through an additional side inlet 8, arranged indifferently on anyone of the four walls, and in particular below the outlet 2, a second "cold" operating fluid, that is a refrigerating fluid, is fed. Such second fluid can be introduced under the liquid, vapour or mixed form. Typically such fluid is freon. To the inlet of the refrigerant fluid 8 a head or closing bottom 80 of known type on itself can be associated.

The second operating fluid is distributed inside the skirt by means of a distributor 9, of known type on itself, and it partially floods the skirt 1. To the purpose of the heat exchange with the first operating fluid in use, the second fluid only floods a portion of the primary tube bundle 10. The remaining portion of the latter is however "fed" by the liquid dragged by the ascending vapour (the latter being indeed the second operating fluid under the aeriform shape). Such vapour is then drawn in a suitable outlet/sucking orifice 11. In the present example, the outlet/sucking orifice 11 is associated to a gas conveyor or "hat" 12 tapered upwards, preferably under truncated-conical shape.

The herein considered exchanger 100 is then of the so-called "one-circuit" (skirt side) type or "more-steps" (tube inner side) type. In embodiment variants providing one single "step", the inlet and the outlet of the first fluid are on opposite sides. In general terms, in case of an "odd" number of steps the inlet and the outlet are on opposite sides of the skirt, whereas in case of "even" number of steps the inlet and the outlet are on the same side.

In case of several circuits on the skirt side, it is necessary keeping several exchangers in "series" (with water side, and in general first operating fluid side, in common).

In the above-mentioned variants other modifications in the arrangement of the components with the understanding of a person skilled in the art are also provided.

At this point it will be better appreciated that the whole configuration of the exchanger 100 is so that the prevalent development dimension of the skirt 1, that is the direction L designated as longitudinal and corresponding to the axis A of the skirt itself, is eve the direction according thereto the second operating fluid flows inside the skirt 1. Such direction, corresponding to the vertical direction in the sofar described arrangement, is substantially orthogonal to the development of the tubes of the primary tube bundle 10. Such configuration allows obtaining a free surface faced towards the sucking orifice 11 with reduced sizes compared to the known art and, consequently, a high flow speed towards the sucking orifice itself. As already illustrated above, in this way the second operating fluid drags in pushed way the liquid refrigerant upwards, by making that the latter bathes the tubes of the primary tube bundle 10 lying along the path and thus acting as "feeder" for the remaining tube bundle itself. As it will be illustrated in greater detail hereinafter, an analogous result can be obtained by configuring the skirt so that its three sizes, that is the one herein designated as longitudinal/vertical and the two sizes on the transversal/horizontal plan orthogonal thereto, can be compared. Satisfying results are further obtained with a specific relationship between the areas of the longitudinal and transversal sections of the skirt, as explained hereinafter.

As already mentioned, the speed of vapour of the second operating fluid which is produced during the thermal exchange is a determining parameter so that an effective dragging of the liquid from the free surface to the surface of the upper tubes is obtained. Such vapour ascending speed mainly depends upon the type and sizes of the used tubes, upon the relative distance between adjacent tubes both in longitudinal L and transversal direction, upon the type of primary and secondary fluid and upon the operating conditions thereof. By mainly taking into consideration the state of art relating the technology of tubes and the set of the other above-mentioned quantities for the use of the evaporator in conditioning industrial plants, some preferred geometric parameters are provided hereinafter in order to obtain an optimum dragging speed to the purpose of an improved efficiency of thermal exchange in terms of the present invention.

Figure 3A:
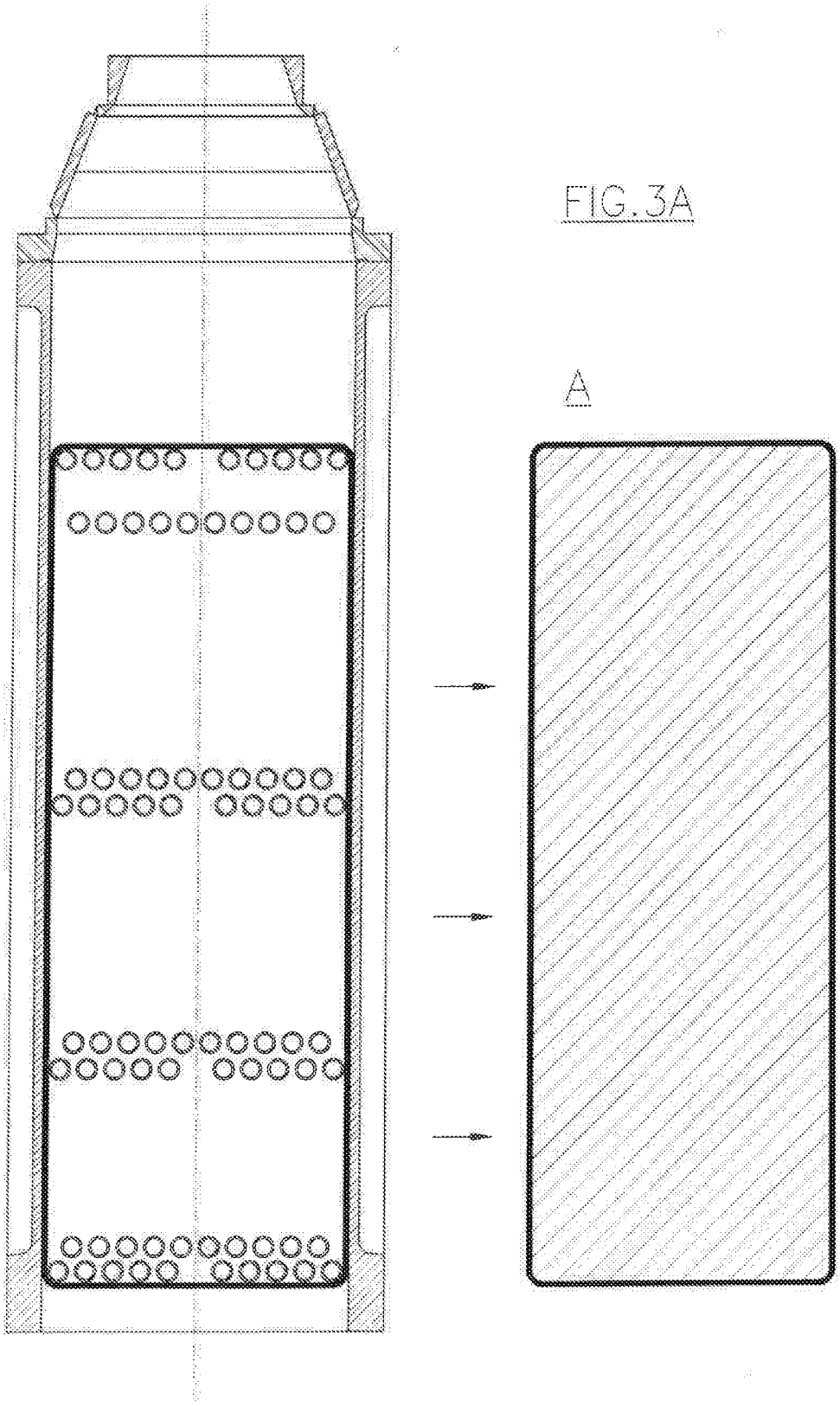
FIG. 3A shows a schematic side representation of the exchanger of FIG. 1, corresponding to the longitudinal section of FIG. 2 and to the plane xz of FIG. 3, showing an area of longitudinal envelopment of a primary tube bundle of the exchanger.
Figure 3B:
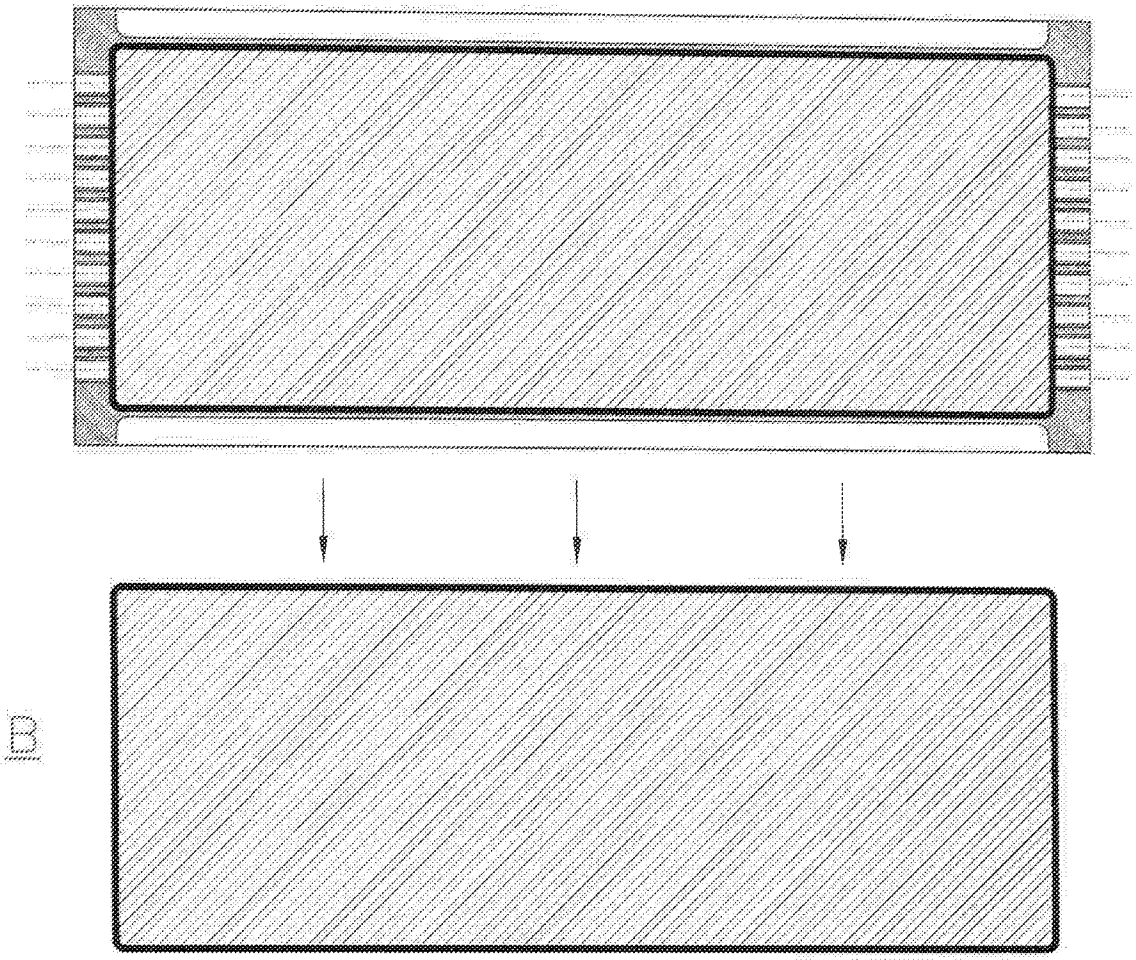
FIG. 3B shows a schematic representation in horizontal section of the exchanger of FIG. 1, corresponding to the plane xy of FIG. 3 and showing an overall cross area of an inner compartment of the exchanger receiving the primary tube bundle.
Figure 3C:
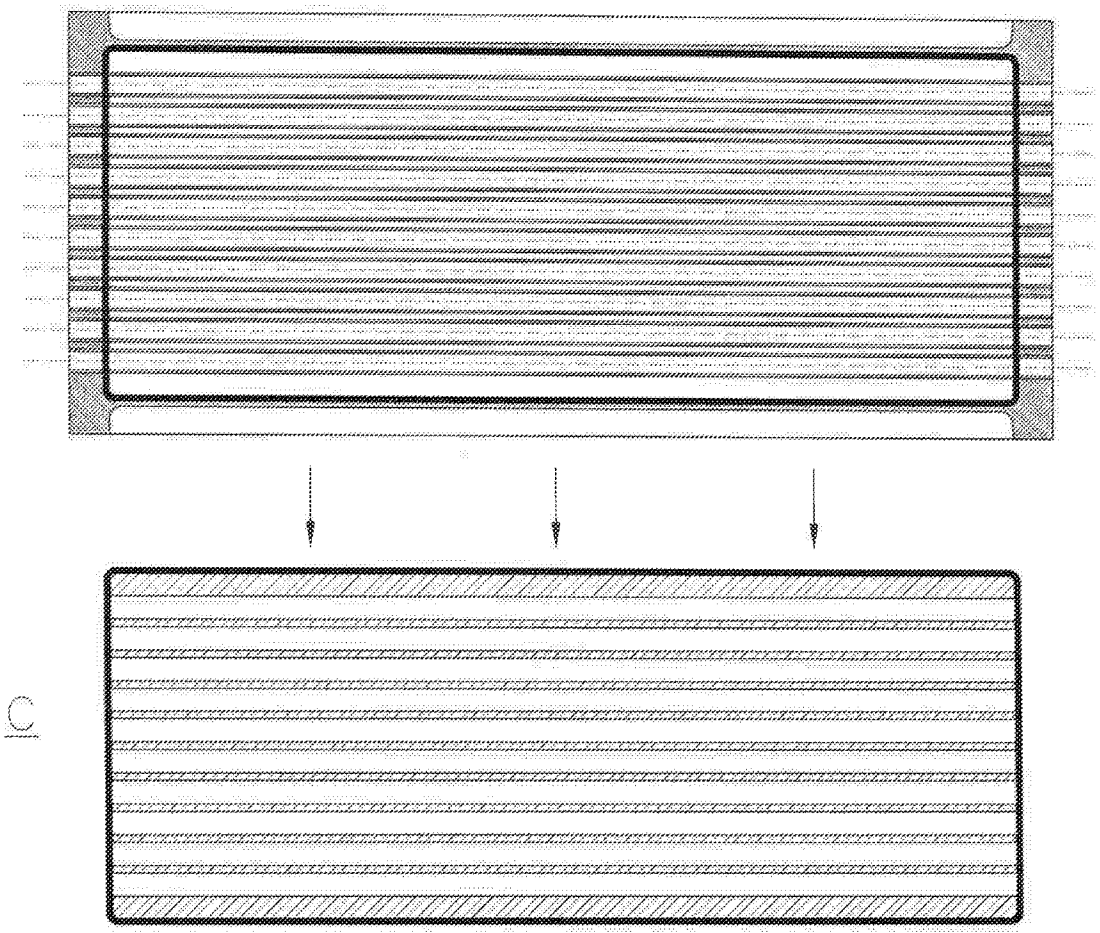
FIG. 3C shows the same view of FIG. 3B, by highlighting a residual area not involved by the tubes of the primary bundle.

By referring to FIGS. 3 to 3C, to the axes xyz represented in FIG. 3 ant to the areas A, B and C respectively shown in FIGS. 3A, 3B and 3C, it is defined:

axis z—axis in longitudinal direction L, A of the skirt 1, which is the vapour ascending direction, the direction orthogonal to the plane (xy) of extension of tubes of tube bundle 10 and, in the sofar considered exchanger 100, the prevalent extension direction of the skirt 1;

axis x—axis in transversal direction of the skirt 1 (orthogonal to the longitudinal direction L, A of the skirt 1), and orthogonal to the prevalent extension direction of the tubes of the bundle 10;

axis y—axis in cross direction of the skirt 1 (orthogonal to the longitudinal direction L, A of the skirt 1), and parallel to the prevalent extension direction of the tubes of the bundle 10;

area A—area of longitudinal envelopment of the primary tube bundle of the exchanger on the plane xz, as shown in FIG. 3A;

area B—overall cross area of an inner compartment of the exchanger receiving the primary tube bundle on the plane xy, as shown in FIG. 3B; in case the extension of such compartment is not constant according to the axis x, the area is taken at the maximum size of the skirt along the axis x;

area C—residual area comprised in the area B and without the cumbersome area of the tubes of the tube bundle, that is the really free area for the vapour passage of the second operating fluid, as shown in FIG. 3C.

According to the invention:

A/B>0.4-0.45, preferably A/B>0.6, and C/B<0.3.

In the above-described embodiment, A/B>0.8 and C/B<0.3.

In the present embodiment, an auxiliary overheating unit of the second operating fluid, designated as a whole with 101 is also provided and interposed between the primary bundle 10 and the conveyor 12.

The auxiliary unit 101 comprises an auxiliary tube bundle 102, crossed, in use, by an auxiliary operating fluid, in the herein described application a so-called "hot" fluid, for example a liquid refrigerant coming from a condensing plant. Even the auxiliary tube bundle 102 has a serpentine-like path, with at least a go-tract and at least a return-tract the length thereof is defined by the distance between a respective inlet tube plate 103 and a respective bottom tube plate 104 arranged at opposite side walls of the skirt 1.

The auxiliary unit 101 provides then an inlet and an outlet 106 and 105 placed side by side at the same side wall of the skirt 1, in turn under the shape or connectors or nozzles known on themselves and associated to a collector or head 107. On the opposite side with respect to the latter a collector or closing bottom 108, leak-tight through gasket, is provided, which is necessary for making the auxiliary fluid to return inside the tubes of the auxiliary bundle 102, after the go-tract.

In another possible configuration, such auxiliary unit can be implemented with the inlet and the outlet positioned on opposite sides, so as to implement odd number of passages of the auxiliary fluid inside the tubes.

In this way, the secondary operating fluid, which in the present application rises after having lapped against the primary tube bundle 10 under the form of humid refrigerant gas, in its path towards the outlet 11 laps against the auxiliary bundle 102, the hot liquid inside the latter (sub) cools down, and the humid secondary gas further heats up with respect to the heat exchange with the primary tube bundle 10. This allows to a compressor arranged downwards the exchanger 100 to suck "dry" and overheated gas, by guaranteeing the total or almost total absence of liquid drops in the gas itself.

At the same time, the auxiliary operating fluid, typically in the liquid state, results to be sub-cooled and it outgoes from the outlet 105.

Such outletting auxiliary fluid cam be re-inserted into the heat exchange through the inlet 8, by entering below the primary tube bundle 10 under the form of "cool" secondary operating fluid. Generally, such re-insertion of fluid in the circuit takes place with the interposition of an expansion/adjustment valve which keeps a wished level of liquid inside the skirt 1.

The above-mentioned auxiliary unit can be implemented even by means of a flanged battery (or more in general by means of any thermal exchange device).

The above-mentioned auxiliary unit can be implemented even as extractable unit, that is a unit which can be inserted in use in the main exchanger according to the specific operating needs, according to the teachings contained in WO 2012/077143.

Figure 2:
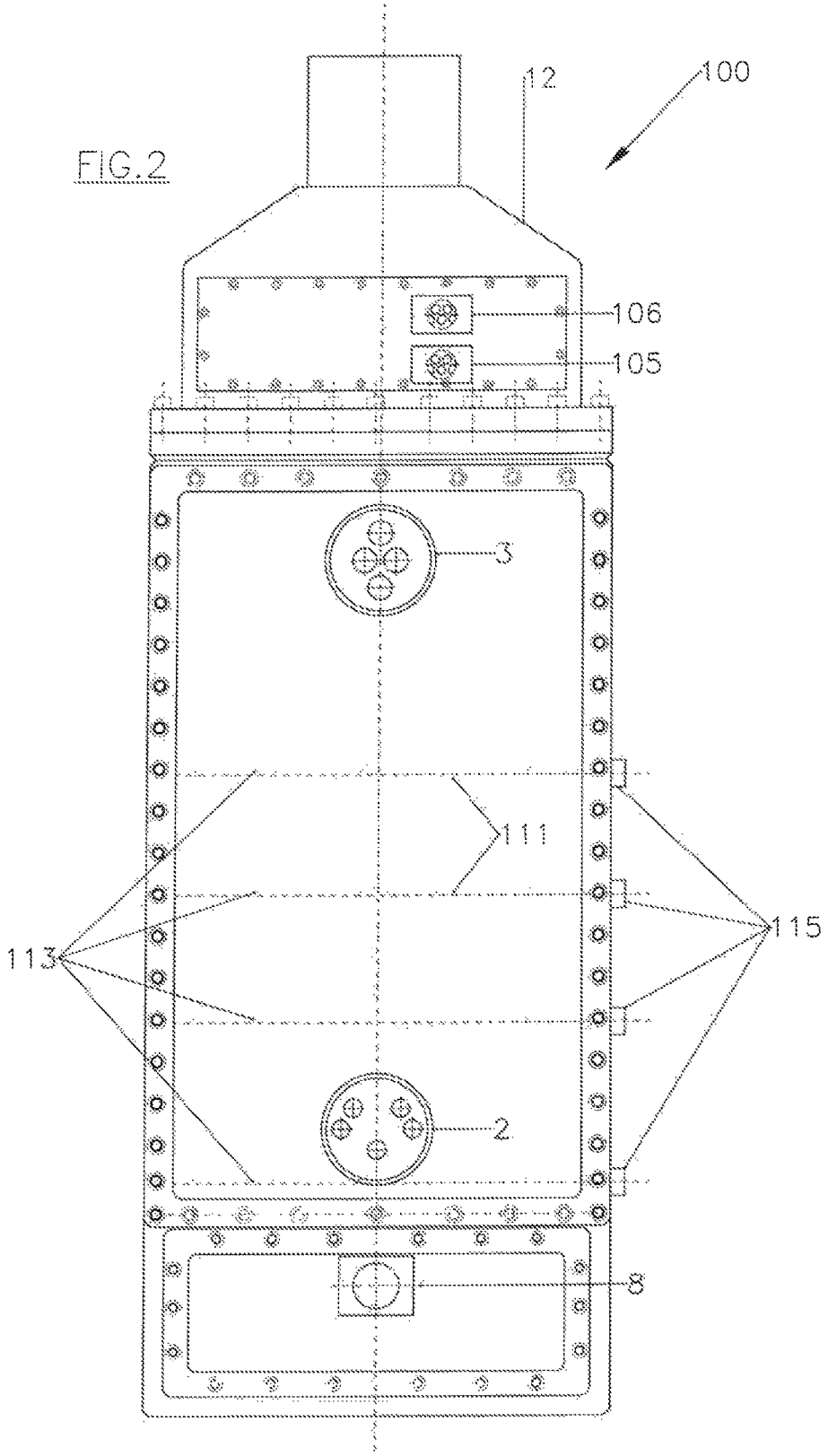
FIG. 2 shows a view in longitudinal section of the exchanger of FIG. 1, performed according to the axis A-A of this last figure.

As it is better visible in FIG. 2, in the present embodiment the exchanger 100 comprises even spray or jet delivery means of the second operating fluid inside the skirt 1, preferably suitable to deliver operating fluid in substantially nebulized form.

The delivery means comprises a plurality of tubes 111 which cross transversally the skirt 1 with more levels with respect to the longitudinal direction A of the skirt itself. On the tubes 111 nozzles or injectors 113 are obtained.

The tubes of the delivery means can be provided to operate divided into two or more groups, each group by distributing refrigerant at an intermediate level of the tube bundle. The groups can be all fed by the same refrigerant feeding line or further grouped in sub-groups, each sub-group being fed by a specific line. In the present example, each tube or group of delivery tubes 111 is fed by a respective inlet 115.

The mass flow of the or each feeding line is adjusted by specific parameters, such as for example the level of the free surface of the refrigerant liquid in the skirt, the overheating value of the vapour outletting the evaporator, the value of the pressures, and/or other.

The delivery tubes 111 can extend parallelly to the extension direction of the tubes of the primary tube bundle 10 or, as shown in FIG. 2, orthogonally to the latter.

As already illustrated, the presence of the delivery means allows reducing even more the refrigerant volume necessary to the exchanger 100. Furthermore, with various injection levels compared to the prevalent extension direction of the skirt 1 (or however compared to the ascending direction of the secondary fluid) and by delivering the high-pressure refrigerant through slots/holes (or nozzles in general) with reduced sizes, the outgoing refrigerant is a fog which can be transported even more easily from the flow of vapour ascending at high speed and therefore in an even more effective way.

The above described delivery means can be provided to be the only feeding elements, that is not in combination with the separate feeding (8), and this can be implemented both in "pure falling-film" and hybrid configuration, that is with a portion of the tubes flooded by the refrigerant.

The present invention has been sofar described by referring to preferred embodiments. It is to be meant that other embodiments belonging to the same inventive core may exist, as defined by the protection scope of the claims reported hereinafter.

The invention claimed is:

1. A heat exchanger adapted to be used in a conditioning plant, comprising:

a primary tube bundle, inside which a first hot operating fluid to be cooled down flows; and a skirt, circumscribed to said primary tube bundle and adapted to receive a second cold operating fluid which laps against said primary tube bundle and subtracts heat to said first operating fluid and evaporates, wherein said primary tube bundle extends transversally, namely horizontally, inside said skirt and said second operating fluid flows inside said skirt, as ascending vapour, according to a longitudinal direction, being a vertical direction, of the skirt orthogonal to the development of the tubes of said primary tube bundle, wherein said skirt has a prevalent development dimension along said longitudinal direction, and the whole configuration is so that A/B>0.4-0.45, and C/B<0.3 wherein: A is an enveloping area of said primary tube bundle on a longitudinal plane orthogonal to a prevalent extension direction of the tubes of said bundle (plane xz); B is an overall area of an inner compartment of said skirt receiving said primary tube bundle on an extension transversal plane of said tubes (plane xy); and C is a residual area comprised in the area B and without the overall dimension area of the tubes of said tube bundle, that is the free area for the passage of vapour of the second operating fluid.

2. The heat exchanger according to claim 1, which is an exchanger of the so-called flooded type wherein the second operating fluid is received over the free surface inside said skirt or an exchanger of the hybrid or pure "falling-film" type.

3. The heat exchanger according to claim 1, comprising a spray or jet delivery element of the second operating fluid inside said skirt.

4. The heat exchanger according to claim 3, wherein said delivery element is configured to deliver operating fluid at multiple levels, in particular intermediate levels, along said longitudinal direction of said skirt.

5. The heat exchanger according to claim 4, wherein said delivery element is suitable to deliver operating fluid in nebulized form.

6. The heat exchanger according to claim 4, wherein said delivery element comprises a plurality of delivery nozzles or injectors received inside said skirt.

7. The heat exchanger according to claim 6, wherein said delivery element comprises one or more tubes crossing said skirt, along a direction transversal to the skirt and parallel or orthogonal to the prevalent extension direction of the tubes of said primary tube bundle, said delivery nozzles or injectors being obtained upon said one or more tubes.

8. The heat exchanger according to claim 7, comprising an ancillary overheating unit, arranged downstream of said primary tube bundle with respect to the flow of the second operating fluid and adapted to produce an additional heating of this latter fluid.

9. The heat exchanger according to claim 1, wherein A/B>0.6.

* * * * *